US008371216B2

(12) United States Patent
Chisholm et al.

(10) Patent No.: US 8,371,216 B2
(45) Date of Patent: Feb. 12, 2013

(54) CONVEYING AND MARKING APPARATUS AND METHOD

(75) Inventors: Keith A. Chisholm, Hackettstown, NJ (US); Alex A. Hanna, Ooltewah, TN (US); Alfred V. Camporini, Hackettstown, NJ (US); David J. Pontzer, Sparta, NJ (US); Thomas DeMare, Blairstown, NJ (US)

(73) Assignee: Mars, Incorporated, McLean, VA (US)

( * ) Notice: Subject to any disclaimer, the term of this patent is extended or adjusted under 35 U.S.C. 154(b) by 574 days.

(21) Appl. No.: 12/629,977

(22) Filed: Dec. 3, 2009

(65) Prior Publication Data

US 2011/0132729 A1 Jun. 9, 2011

(51) Int. Cl.
*B41F 17/36* (2006.01)

(52) U.S. Cl. ..... 101/44; 101/35; 198/867.11

(58) Field of Classification Search ..... 101/35, 101/41, 44; 198/867.11, 867.12, 803.14, 198/803.15; 426/383; *B41F 17/36*
See application file for complete search history.

(56) References Cited

U.S. PATENT DOCUMENTS

| | | | | | |
|---|---|---|---|---|---|
| 4,189,996 | A | * | 2/1980 | Ackley et al. | 101/37 |
| 4,905,589 | A | | 3/1990 | Ackley | 101/35 |
| 5,423,252 | A | | 6/1995 | Yamamoto et al. | 101/35 |
| 5,685,220 | A | | 11/1997 | Steffen et al. | 101/37 |
| 5,813,513 | A | * | 9/1998 | Taube | 198/803.14 |
| 5,836,243 | A | | 11/1998 | Ackley | 101/44 |
| 5,878,658 | A | | 3/1999 | Ackley | 101/35 |
| 5,894,801 | A | | 4/1999 | Ackley | 101/485 |
| 5,979,309 | A | | 11/1999 | Boyce | 101/35 |
| 5,988,364 | A | | 11/1999 | Boyce et al. | 198/867.15 |
| 5,996,768 | A | | 12/1999 | Boyce et al. | 198/397.01 |
| 6,286,421 | B1 | | 9/2001 | Ackley | 101/38.1 |
| 6,314,876 | B1 | | 11/2001 | Ackley | 101/44 |
| 6,390,280 | B1 | | 5/2002 | Boyce | 198/540 |
| 6,823,795 | B2 | | 11/2004 | Willcocks et al. | 101/492 |
| 7,102,741 | B2 | | 9/2006 | Ackley, Jr. et al. | 356/237.1 |
| 7,182,018 | B2 | | 2/2007 | Ackley, Jr. et al. | 101/35 |
| 2003/0035870 | A1 | | 2/2003 | Ackley, Jr. et al. | 426/383 |
| 2003/0177919 | A1 | | 9/2003 | Volder | 101/41 |
| 2004/0094050 | A1 | | 5/2004 | Ackley, Jr. et al. | 101/44 |
| 2005/0046103 | A1 | | 3/2005 | Hachiya et al. | 271/69 |
| 2006/0087051 | A1 | | 4/2006 | Bunick et al. | 264/109 |
| 2007/0062404 | A1 | | 3/2007 | Ackley, Jr. et al. | 101/485 |
| 2007/0125625 | A1 | | 6/2007 | Ackley | 198/867.11 |
| 2007/0194034 | A1 | | 8/2007 | Vasiadis | 221/21 |
| 2007/0267274 | A1 | | 11/2007 | Steffen et al. | 198/689.1 |
| 2008/0158332 | A1 | | 7/2008 | Ackley et al. | 347/264 |
| 2008/0236414 | A1 | | 10/2008 | De Volder | 101/41 |
| 2009/0059214 | A1 | | 3/2009 | Ackley, Jr. et al. | 356/237.1 |

FOREIGN PATENT DOCUMENTS

| | | | |
|---|---|---|---|
| EP | 0 183 611 | B1 | 2/1990 |
| EP | 0 915 014 | A1 | 5/1999 |
| GB | 2279615 | A | 1/1995 |
| JP | 2007/308308 | | 11/2007 |
| WO | 91-01884 | | 2/1999 |
| WO | 01-94116 | | 12/2001 |
| WO | 03-082575 | | 10/2003 |
| WO | 2004-080191 | | 9/2004 |
| WO | 2008-049119 | | 4/2008 |
| WO | 2008-024267 | | 8/2008 |
| WO | 2009-026103 | | 2/2009 |

* cited by examiner

*Primary Examiner* — Leslie J Evanisko
(74) *Attorney, Agent, or Firm* — Fitzpatrick, Cella, Harper & Scinto

(57) ABSTRACT

A conveying and marking apparatus is disclosed that can convey discrete pieces at high speeds, and in preferred embodiments permits marking on opposite sides of the pieces while the pieces remain in the same position on the conveyor.

20 Claims, 5 Drawing Sheets

CONVEYING AND MARKING APPARATUS AND METHOD

BACKGROUND OF THE INVENTION

1. Field of the Invention

The invention is directed generally to conveying and marking apparatus and methods, and more particularly to an apparatus that can load, convey, and mark discrete pieces at high speeds. In preferred embodiments, the invention permits marking on opposite sides of the pieces and marking the pieces with high resolution, multicolor and/or composite images in registration. In embodiments, the apparatus and methods may be used to provide for direct customization of printed edibles by consumers, over the Internet or in a retail setting, for example.

2. Description of the Related Art

A conventional apparatus for printing discrete pieces is described in U.S. Pat. No. 4,905,589, comprising carrier bars attached to a conveying chain. The carrier bars are positioned side by side to form an essentially continuous conveying surface which follows a transport path. Pockets are provided in the carrier bars to carry small pieces, which are loaded into the pockets at an inclined portion of the transport path and printed on a horizontal portion of the transport path.

The design of the carrier bar systems limits the overall speed at which the pieces can be conveyed. Speeds of 50 to 75 feet per minute (15 to 23 m/min) are typical for conventional carrier bar systems, with 100 feet per minute (30 m/min) being a practical maximum. Above this speed, pieces begin to rattle in the pockets and pop out during transport.

Filling the pockets at high speeds also poses a problem. At higher speeds the pocket is exposed to the piece for a shorter duration of time. The pieces may skip over the pockets, or travel on the carrier bar surface, limiting the percentage of the pockets that can be filled reliably at high speeds ("fill efficiency").

Another drawback of conventional conveying and marking apparatus is the difficulty of printing on two sides of a piece. In order to print on two sides of a piece transported in the carrier bar pockets, the pieces have to be loaded onto a drum to turn them over, as described in U.S. Pat. No. 5,878,658. Alternatively, U.S. Pat. No. 5,423,252 discloses an apparatus for printing on two sides of a solid article, such as a tablet or capsule, by transferring the article from a first belt or chain conveyor to a second belt or chain conveyor. Other carrier bar configurations are available in which tablets are vertically oriented (i.e., sitting on their edge) within a cavity having two openings for printing on opposite sides of the tablets. However, these vertically oriented carrier bars suffer from the same maintenance issues and the same limitations as to operating speed and throughput as the horizontally arranged carrier bar systems. Because of the way they are constructed, the vertically oriented carrier bars are limited to printing on a single lane of pieces, which limits throughput, and portions of the printing surface are obscured by multiple portions of the carrier bar.

There is also a need in the art for conveying and marking apparatus that can be used to print multiple images on a piece by holding the piece in registration between print stations without relying on vacuum or trapping mechanisms to secure the piece. U.S. Pat. No. 7,182,018, owned by the assignee herein and incorporated by reference, teaches methods and apparatus for conveying articles in registration between two print stations to form a composite, registered image using a vacuum or trapping mechanism to prevent the piece from skewing or yawing between printing steps.

U.S. patent application Ser. No. 09/587,108, owned by the assignee herein and incorporated by reference, teaches a system and apparatus for high resolution printing on edibles which permits a consumer to submit an image using a computer to a second computer so that a customized edible product can be printed with the image. This may be practiced over the Internet for example, or in a retail setting. There is a particular need for rapid handling of pieces to be custom-printed according to a consumer's preferences on an as-you-wait basis in a retail setting. However, conventional systems for printing on discrete pieces are generally too large to be accommodated in a retail setting.

In view of the foregoing description of the prior art and problems to be solved, one object of the invention is to provide a conveying and marking apparatus that provides for higher transport speed of discrete pieces, especially edible pieces. The ability to transport pieces at high speeds may be significant in increasing throughput in a mass production setting or, for example, in a retail setting where custom-printed edible pieces are prepared for consumers on an as-you-wait basis.

Another object of the invention is to provide for dual-sided printing on a piece without requiring transfer of the piece to a separate conveyor, preferably allowing multiple lanes of pieces to be printed.

Still another object of the invention is to improve the design of the cavity holding the piece, on one hand allowing greater fill efficiency of the pieces in the cavities, and on the other hand allowing the pieces to be securely held in place during transport, for example, to prevent skewing and yawing between printing steps.

Still another object of the invention is to provide a conveying and marking apparatus that takes up less floor space and uses fewer complex elements of construction, which features may be particularly attractive in a retail setting.

There is a particular need for these advances in the field of printing on edible pieces, as there is an increasing demand in this field for consumer-initiated and consumer-designed edible products. These applications require quick and easy changeover to permit different articles to be printed with different customized images, as well as high throughput of edible pieces for rapid turnaround of orders. These and other objects of the invention are achieved according to the invention described and claimed herein.

SUMMARY OF THE INVENTION

Figure 1:
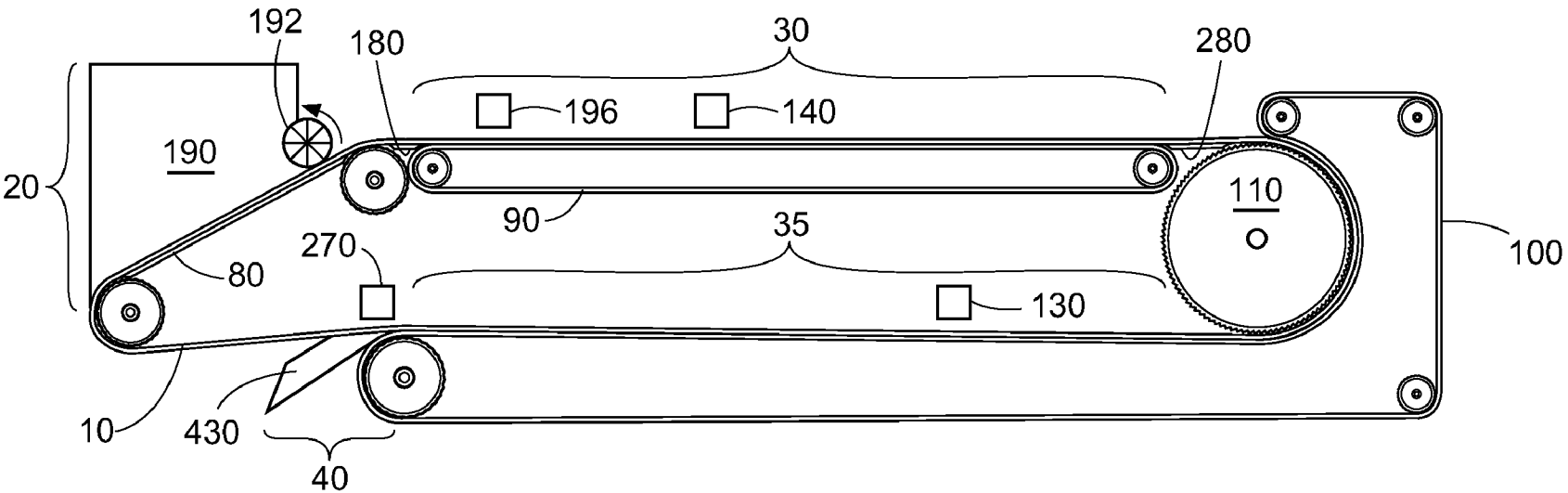
FIG. 1 is a schematic side view of the conveying apparatus according to an embodiment of the invention.

In one aspect, the invention is a conveying and marking apparatus comprising: a continuous flexible conveying belt having a first side and a second side. At least one cavity extends through the conveying belt adapted to receive an individual piece and having an opening on the first side and an opening on the second side. A conveyor is adapted to move the conveying belt along a transport path including an inclined portion and a linear portion. At least one retaining member is positioned against one opening of the cavity. A dispenser is adapted to dispense an individual piece into the cavity, and a marking unit is positioned proximate the linear portion, adapted to mark the piece positioned in the cavity.

In preferred embodiments, the openings are dimensioned to permit printing on the piece through the openings on the first and second side. For example, the openings may afford a marking unit with a substantially unobstructed view of the surface area of the piece facing the unit, or with a view obstructed only by a very small notch in the rear sidewall of the cavity which can be used to hold the piece in position.

In preferred embodiments, the retaining member comprises a back-up belt contacting the conveying belt along a portion of the transport path to hold the piece in the cavity. In other embodiments one or more retaining plates are used. In still other embodiments, one or more retaining plates and one or more back-up belts may be used in combination, contacting the conveying belt along different portions of the transport path.

The cavity in the belt may comprise a scalloped portion at the leading edge of the cavity, including a sloped surface extending at an angle from the leading edge of the cavity to the leading sidewall of the cavity to lead the piece into the cavity during loading. The cavity may also comprise a notch formed in the trailing sidewall of the cavity to secure the piece in the cavity. Cavities may be arranged in lanes running lengthwise on the belt.

In the most preferred embodiments, the invention is a dual-sided printing unit incorporating the flexible belt described above, and further comprising a first marking unit and a second marking unit. The first marking unit may be positioned to mark a first surface area of the piece through an opening on a first side of the conveying belt, and the second marking unit may be positioned to mark a second surface area of the piece through an opening on a second side of the conveying belt, opposite said first side.

The marking unit may be any type of printer or etching unit known in the art, or combination thereof, including without limitation, continuous-jet or drop-on-demand ink-jet printers. Drop-on-demand includes bubble-jet (thermal) or piezo-jet printers. Drop-on-demand printing technology includes print heads adapted to print with water-based inks, solvent-based inks or phase change inks. Another type of marking technology suitable for use with the invention comprises selectively inducing a color change in a coating on a surface of the piece with a low power $CO_2$ laser. Other printers known in the art may also be used without departing from the scope of the invention, including rotogravure, offset, and laser. An etching unit instead of a printer may be used, alone or in combination with a printing unit.

In a typical application, a marking unit may be positioned above a horizontal linear portion on the transport path and the dispenser may be positioned at an inclined portion on the transport path. The apparatus may include inspecting devices, such as one or more laser sensors (reflectance or through-beam) or capacitance-type devices, to determine if cavities are filled, or to inspect the pieces after they have been printed to determine if they have been printed correctly or damaged. Preferably, the operation of the marking unit is controlled such that printing is not performed at a cavity determined to be empty by the inspection device.

In another aspect, the invention is a method for conveying and marking pieces, comprising the steps of: conveying a continuous flexible conveying belt along a transport path which includes an inclined portion and a linear portion. The belt has a first side and a second side. At least one cavity is provided extending through the conveying belt having an opening on the first side and an opening on the second side, adapted to receive an individual piece. An individual piece is dispensed into the cavity on the inclined portion of the transport path and retained in the cavity with at least one retaining member positioned against one opening of the cavity. A marking unit is positioned proximate the linear portion which marks the piece when the piece is proximate the marking unit on the transport path. Typically, the conveying belt has lanes of cavities, and a plurality of pieces are loaded into the cavities on the inclined portion of the transport path.

The method may include inspecting the cavities to determine if they are filled, or inspecting the pieces after they have been printed to determine if they have been printed correctly or damaged. If a cavity is determined to be empty, the step of marking may be skipped for that cavity. The method may include a step of removing pieces that are damaged or that have not been printed correctly.

In preferred embodiments of the method, the conveying belt is contacted with a back-up belt along a portion of the transport path to hold the piece in the cavity, and the openings on opposite sides of the belt provide access to opposite surface areas of the piece. A cavity provided with two openings on opposite sides permits marking a first surface area of the piece through an opening on a first side of the conveying belt in a first marking step, and marking a second surface area of the piece through an opening on a second side of the conveying belt, opposite said first side, in a second marking step.

Handling of the pieces is improved by providing a scalloped portion at a leading edge of the cavity in the direction of movement of the conveying belt which leads the piece into the cavity when the piece is dispensed onto the belt. After being led into the cavity, the piece may be secured by a notch formed in the trailing sidewall of the cavity.

In the most preferred embodiments of the invention, the piece is an edible piece and the surfaces in contact with the piece are made of food-contact grade materials.

DETAILED DESCRIPTION OF THE PREFERRED EMBODIMENTS

Definitions

The terms "belt" is used herein according to the customary meaning to describe a continuous band of flexible material. A "conveying belt" is a belt used for conveying articles. A "continuous flexible conveying belt" is likewise a belt that can be flexed around rollers to form a continuous, uninterrupted surface. Thus, these terms are synonymous. A band or belt is in the form of a thin flat strip, such that it has two major flat sides or faces, referred to herein as the first side and the second side.

The term "cavity" is used herein to refer to a space formed in the belt. The perimeter of the cavity on a side of the belt is referred to as an "opening" of the cavity, which may be on the first side and on the second side, as the cavity extends through the belt. The belt has a direction of travel, so that the cavity has a "leading edge," referring to that part of the opening on the first side of the belt toward the direction of travel, and a "trailing edge," referring to that part of the opening on the first side away from the direction of travel. Similarly, the interior of the cavity is defined as having a "leading sidewall" and a "trailing sidewall." In embodiments, the cavity has a "notch," which is an indentation or cutout in a sidewall of the cavity, typically in the trailing sidewall of the cavity.

In its broadest application, the apparatus described herein can transport any discrete piece. In embodiments, the piece has a three-dimensional shape having a nonplanar surface that can be printed on, such as an ovoid, spheroid, or lentil shape. However, a particularly preferred application is the conveying and marking of edible pieces. The term "edible" means that which can be eaten by humans or animals as food, and should be distinguished from "non-toxic," which is something that may be ingested and tolerated, but which is not consumed as food. In the application of the apparatus to edible pieces, "food-contact grade" refers to materials meeting standards such as those adopted by the United States Food and Drug Administration (FDA) for surfaces and instruments that are used in food processing and drug processing facilities.

In certain embodiments, the apparatus is used to convey edible confectionery including, without limitation, gum, sugar-shelled confections, and pressed tablet confections. Examples of sugar-shelled confectionery that can be used with the apparatus of the invention include, without limitation, M&M'S® Milk Chocolate Candies, SKITTLES® Bite Size Candies, M&M'S® Milk Chocolate Peanut or Milk Chocolate Almond Candies. Pet food and pet treats may also be printed using the apparatus of the invention.

The conveying belt according to the invention is moved along a transport path having at least one inclined portion and at least one linear portion. As used herein, "inclined portion" means a portion having a change in elevation, and it is not required to be straight or at a fixed angle. Loading of the pieces into the belt cavities is preferably accomplished at the inclined portion. In embodiments, the pieces are dispensed onto the belt at an inclined portion which is curved to facilitate loading. In these embodiments, the inclined portion includes a curved portion which may have one or more angles of curvature.

As used herein, "linear" means in a straight line. It is preferred to print on the pieces while they are transported on a linear path. In some cases, printing is performed while the pieces are on the inclined portion, in which case a "linear portion" of the transport path may be within the "inclined portion."

As used herein, "small-scale" and "production-scale" refer to the number of pieces that can be conveyed and marked with a given unit per hour. For example, a "small-scale" unit typically may load and convey about 6000 sugar-shelled confectionery pieces per hour, while a production-scale unit may convey up to about 1,000,000 pieces per hour. However, scale is not a critical aspect of the invention, and one of ordinary skill in this art would understand that "small-scale" and "production-scale" are qualitative terms, and that the rate of pieces processed by a given apparatus is likely to vary depending on the properties of the piece, and other factors. In preferred embodiments, the belt is capable of being transported at greater than about 100 feet per minute (30 m/min), preferably greater than about 200 feet per minute (61 m/min), and more preferably at about 300 feet per minute (91 m/min).

The Transport Path

As shown in FIG. 1, the conveying belt 10 may be adapted to form a circuit conforming to the transport path, including loading portion 20, first marking portion 30, second marking portion 35, and unloading portion 40. The length of the belt in a production-scale apparatus is in a range of about 1.5 m to about 12.5 m, preferably about 2.5 m to about 8 m, and more preferably in a range of about 4 m to about 6.7 m. For a small-scale unit, factors such as the desired throughput and the floor space allocated to the unit are considered to determine an appropriate length for the belt. The length of the belt in the type of unit shown in FIG. 7, for example, is in a range of about 1 m to about 4 m, preferably about 1.5 to about 2.5 m.

Figure 7:
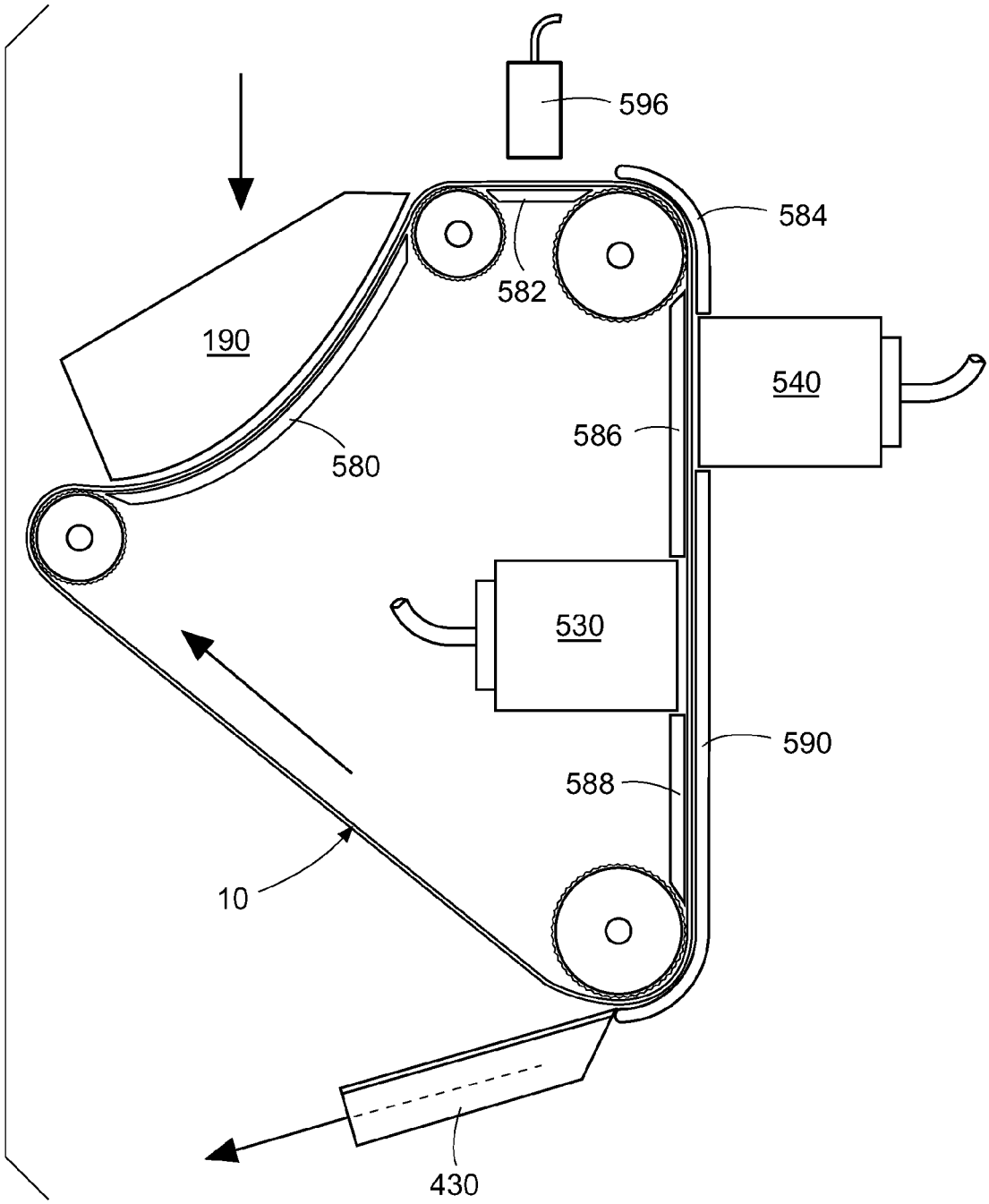
FIG. 7 is a perspective view of an apparatus according to a second embodiment of the invention, wherein printing is conducted on a vertical linear portion of the belt path.

Discrete pieces (not shown) are dispensed from dispenser 190 onto the conveying belt 10 at the loading portion 20 of the transport path located on an inclined portion of the transport path. Brush 192 may be used to guide pieces into cavities on the belt. The incline may have a curved shape such as an arcuate or sigmoidal shape. In embodiments, the loading portion has a concave curve, which may be along only a portion of the inclined portion or along its full length, as shown in FIG. 7. The curve prevents a piece from travelling up the incline with the belt while not in a cavity on the belt, thereby facilitating loading of the pieces into the cavities.

The overall angle of the inclined portion may be fixed or adjustable, and is predetermined according to specific criteria, including the operating speed of the conveying belt, the physical properties of the piece (e.g., size, shape, weight, density, and surface characteristics), the surface characteristics of the belt, and factors contributing to frictional force between the piece and the belt (such as molecular adhesion, deformation of one or both surfaces, and surface roughness). The angle of the inclined portion of the transport path is selected in accordance with these criteria to ensure a cascading motion of the pieces to the lowest part of the dispenser 190 prior to the pieces being received into the cavities. As described below, an inspection unit 196 may be provided to ensure maximal loading of the pieces into the belt cavities. Information from the inspection may be provided to the print heads to prevent printing on unfilled cavities or to control the loading process.

The Conveying Belt

According to the invention, the conveying belt is a continuous band of flexible material, strong enough so that the belt does not stretch significantly during use, even when operated continuously at high rates of speed, and also flexible enough so that it can be shaped to conform to a transport path, which forms a circuit or loop around several rollers. The belt is preferably made of a polymeric material, which is exemplified by a plastic, rubber, or non-metal composite material, either natural or synthetic, but is not limited to these. Polyurethane and Neoprene are typical belting materials. The conveying belt most preferably is a reinforced urethane material. Reinforcement materials include, without limitation, Kevlar® cord, high strength steel, fiberglass, natural fibers (such as cotton thread) or synthetic fibers. The conveying belt may have reinforcing metal components, but the majority of the belt itself is not made of metal. The conveying belt material should be selected to provide a low coefficient of friction with respect to the piece in order to obtain the desired mass flow behavior of pieces dispensed onto the conveying belt. Where the pieces conveyed by the belt are edible pieces, the conveying belt is preferably made of food-contact grade materials. A low coefficient of friction between a material such as polyurethane and an edible piece may be achieved by coating the conveying belt with a DuPont™ Teflon® fluoropolymer resin coating, silicone, a food-contact grade oil or release agent, or the like.

Figure 2:
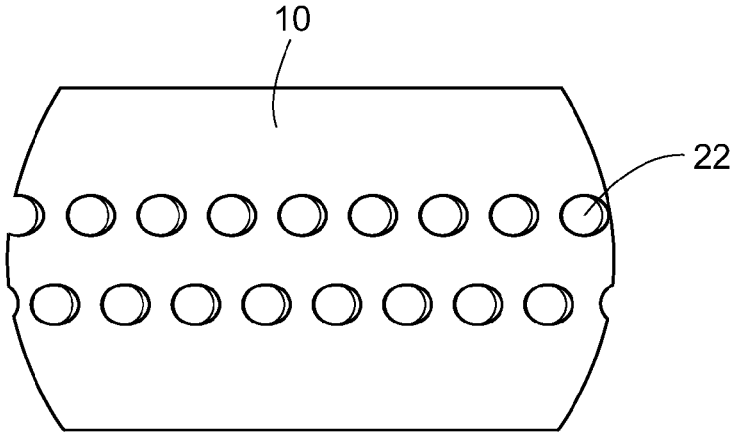
FIG. 2 is a schematic plan view of the conveying belt of the apparatus showing the cavities of the belt as seen from above in an embodiment of the invention.

A plurality of cavities 22 may be arranged in lanes along the length of the conveying belt as shown in the plan view of FIG. 2. For example, the conveying belt of a small-scale unit may have a plurality of cavities arranged in one lane, while a production-scale unit may have a plurality of cavities arranged in two to thirty lanes. The conveying belt of FIG. 2 has two lanes. The dimensions of the cavities, and the dimensions of the cavities relative to the conveying belt dimensions, may vary depending on the size and shape of the piece being conveyed. In the context of printing on M&M'S® Milk Chocolate Candies, the thickness of the belt may be in a range of about 4 mm to about 8.5 mm, preferably about 6 mm to about 7.5 mm.

When the piece is to be marked using a non-contact marking technology, the belt thickness may be selected so that the highest point of the piece as it sits in the cavity is even with or slightly below the surface of the belt. When a contact marking technology is used, the piece may protrude above the surface of the belt so that the area to be marked is fully accessible to the marking unit, care being taken not to damage the pieces with the contact printing member.

Figure 3:
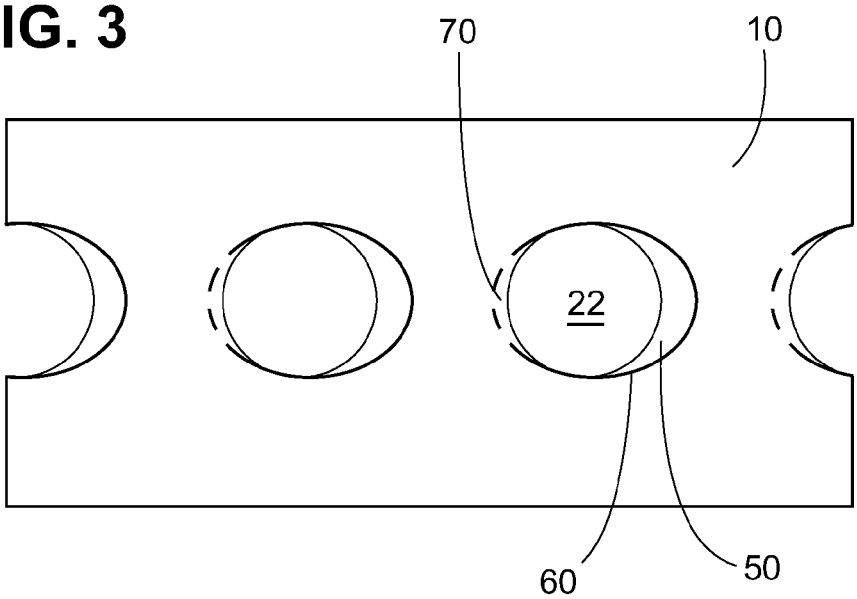
FIG. 3 is an expanded detail of two cavities shown in plan view and showing details of the leading and trailing portions of the cavities according to an embodiment of the invention.
Figure 4:
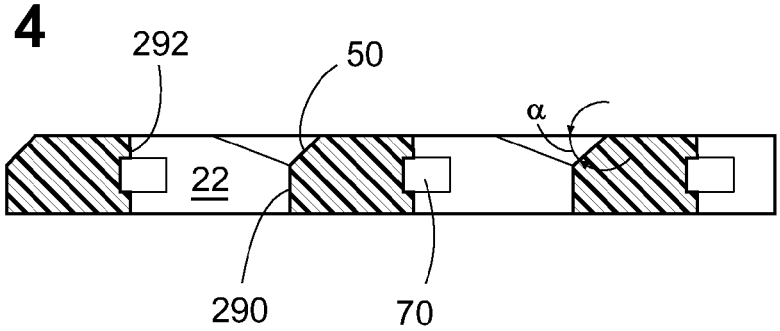
FIG. 4 is a side cross-sectional view of the belt in an embodiment of the invention.

As shown in FIG. 3 and FIG. 4, each cavity 22 may be provided with a leading edge 60 shaped to facilitate maximal loading of pieces from the dispenser. A sloped surface 50 extends at an angle from the leading edge 60 at the surface of the belt on the first side to the leading sidewall 290 of the cavity. The sloped surface may extend about 30% to about 50% of the thickness of the belt, forming an angle $\alpha$ between about 30 degrees and about 45 degrees with respect to the surface of the belt on the first side. The cavity may be scalloped at the leading edge so that the widest dimension of the cavity (along the central axis of the cavity in the direction of travel) is in a range of about 40% to about 60% wider than the narrowest dimension of the cavity measured along the same axis. In preferred embodiments, the trailing sidewall of the cavity 292 is not intersected by a sloped surface, and meets the surface of the belt on the first side at approximately a right angle.

The purpose of the scalloped portion at the leading edge of the cavity is to lead the piece into the cavity formed such that, when the piece is seated in the cavity, there is more distance between the leading edge of the cavity and the piece than between the trailing edge of the cavity and the piece. This design facilitates maximal filling of the cavities with pieces when loaded on the inclined portion of the transport path, and improves the overall efficiency and productivity of the apparatus.

Figure 4B:
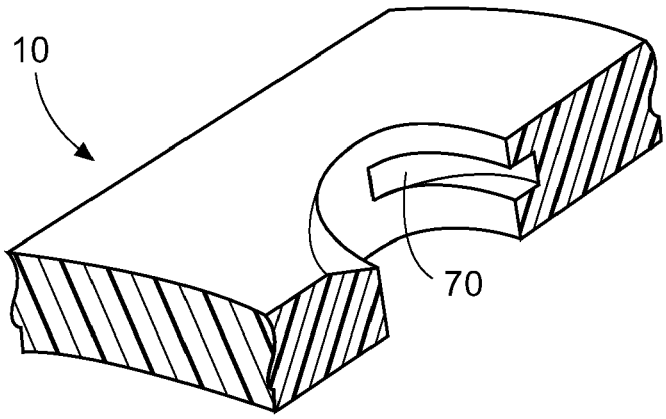
FIG. 4B is an isometric view of a cavity according to a preferred embodiment of the invention, having a notch and a scalloped leading edge.

The trailing sidewall of the cavity may be provided with a notch 70, also shown in FIG. 3 and FIG. 4. FIG. 4B is a reversed isometric view of the cavity, such that the leading edge of the cavity is on the left. The notch 70 helps to secure the piece in the cavity during transport and prevents skewing or yawing of the piece. Accordingly, the one or more surface areas of the piece to be marked remain stationary within the cavity, and images may be successively marked on the piece in substantial registration. The notch is located between the first side and second side surfaces of the belt and may occupy about 30% to about 50% of the thickness of the belt. Preferably, the notch height (i.e., the vertical dimension of the recess on the trailing sidewall of the cavity), and depth (i.e., the dimension measured at the deepest point in the recess from the trailing sidewall of the cavity) are selected so that the piece is secured in the cavity without coming into contact with the back wall of the notch. The preferred belting materials, such as polyurethane, have a degree of stickiness which helps to secure the piece in the notch.

Figure 5A:
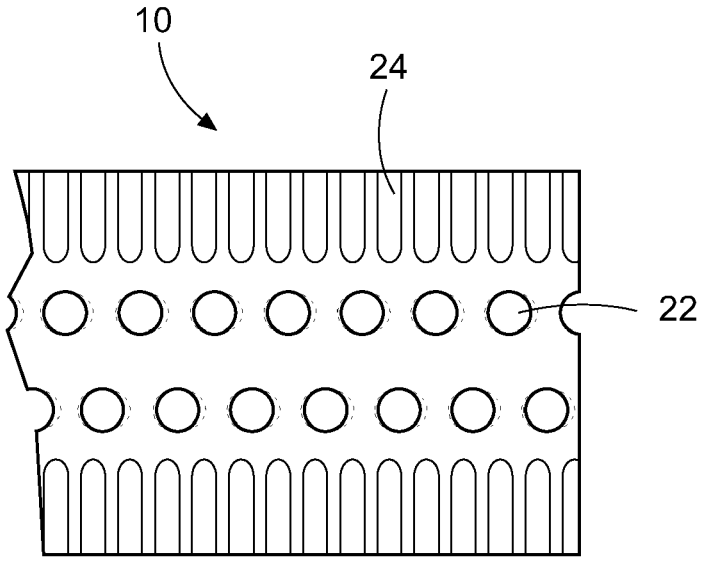
FIG. 5A is an expanded detail view of the conveying belt, as seen from below.
Figure 5B:
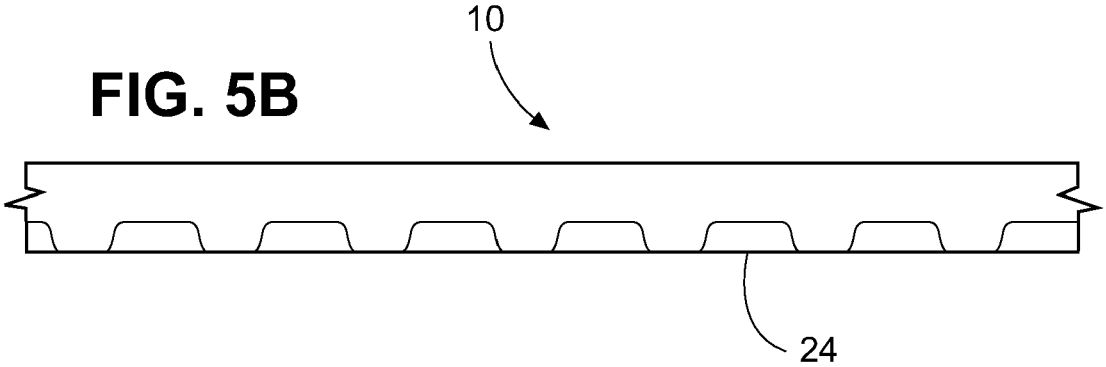
FIG. 5B is an expanded side detail view of the conveying belt, showing the timing teeth for engaging the conveyor according to an embodiment of the invention.

As shown in FIGS. 5A and 5B, timing teeth 24 may be molded, cut or otherwise formed into the second side surface of the conveying belt on a lateral side of the conveying belt. The spacing of the timing teeth may be selected by those of skill in the art according to the size and overall speed of the conveying belt, in a manner known to one of ordinary skill in this art. In an operative example, the center-to-center pitch P of the timing teeth is about 12.7 mm, but could be varied in a range of about 2 mm to about 32 mm, without departing from the scope of the invention.

Retaining Member

In embodiments, at least one retaining member is positioned against one opening of the cavity at some point in the transport path. In the embodiment shown, different retaining members are used, so that at least one retaining member is positioned against at least one opening of the cavity along the transport path from the loading portion 20 to the unloading portion 40. This is especially the case when the opening on the first side of the conveying belt and the opening on the second side of the belt are both large enough that the piece would otherwise pass through the cavity. Referring again to FIG. 1, in the embodiment shown, a static retaining plate 80 is positioned against the openings of the cavities on the second side of the conveying belt when the pieces are loaded at the loading portion 20, and additional static retaining plates 180 and 280 are positioned against the second side of the belt in areas of transition to and from the first marking portion 30 of the transport path. Along the first marking portion 30, a back-up belt 90 is positioned against the openings of the cavities on the second side of the conveying belt. To effect dual-sided printing, a second back-up belt 100 is provided, contacting the conveying belt and positioned against the openings of the cavities on the first side of the belt along the portion of the transport path traveling around drum 110. The second back-up belt 100 cooperates with drum 110 to keep the pieces in the cavities as the conveying belt travels around drum 110. After traveling around the drum, the first side of the conveying belt faces down. Therefore, after traveling around drum 110, each piece in a cavity has its opposite side (i.e., the side not already marked) facing up. An extension of the second back-up belt 100 is positioned against the first side of the conveying belt at the second marking portion 35 of the transport path. The materials of construction of the back-up belts are the same materials used for the conveying belt, although this is not critical.

The back-up belts have timing teeth like the conveying belt, and may run at the same rate as the conveying belt, driven by appropriate motors and pulley systems. The difference in turning radius of the conveying belt and second back-up belt 100 at the drum 110 causes a difference in belt speeds as the belts turn around the drum, resulting in slip between the belts which may result in damage to the piece. This can be accommodated in many cases, but it is preferable that the back-up belts and the conveying belt move at the same speed in the linear portions of the transport path where marking is performed. In a preferred embodiment, different back-up belts and associated drive systems may be provided for each linear portion on the transport path and for the portion of the transport path around the drum 110.

A back-up belt moving with the conveying belt is a preferred retaining member, as compared to a static plate, because a back-up belt in close contact with the conveying belt moving at the same speed as the conveying belt will protect the product from damage such as scuffing. Moreover, a back-up belt may be easily scraped or cleared of ink or other product residue where the back-up belt is not in contact with the conveying belt. This may be done continuously or intermittently while the apparatus is being operated. A static plate that is always in contact with the conveying belt may be more difficult to clean, especially while operating the apparatus.

The Conveyor

The conveyor generally includes a drive system to move the conveying belt along a transport path. In a preferred embodiment, the drive system includes a drive motor on the conveyor belt, and an independent drive on one or more back-up belt(s). Alternatively, a drive motor can be provided for the conveying belt combined with a slave drive belting or gearing to drive the back-up belt(s). The speed of the conveying belt may vary up to about 300 feet per minute (91 m/min), depending on the ability to feed the pieces reliably without damage, and achieve good fill efficiency (i.e., the percentage of cavities filled with pieces during loading). A typical operating speed is about 200 feet per minute (61 m/min), although this is not critical. Speed can be varied via inverter or servo controller input, activated by operator intervention or sensor input based on the amount of product in the dispenser 190, PLC monitoring of fill efficiency, and/or inspection of incorrectly printed or damaged pieces. Another factor limiting the practical speed of the drive system is the time required to dry the pieces. For phase change ink applied with a high resolution ink-jet printer, there is no drying time necessary. For solvent and water-based systems, drying time can be incorporated into the process and determined taking into consideration the length of the conveyor, the speed of the conveying belt, and condition of the drying air. Throughput depends on the size and weight of the pieces and other factors. A small-scale unit having one lane, as might be provided in a retail environment, may operate at a throughput of about 6000 pieces per hour. In a production-scale unit, depending on the number of lanes and many other factors, a throughput in a range about 187,000 pieces per hour to about 1,000,000 pieces per hour may be achieved. The speed of operation and throughput of the apparatus according to the invention may be optimized and may exceed these stated values.

Marking and Inspection Units

As noted above, the openings on the first and second sides of the conveying belt are preferably dimensioned to permit printing on first and second surface areas of the piece, respectively (whether or not two printing steps are employed). The dimensions of the openings can be determined based on the size of the image selected and on the size of the print head or other marking unit used. This determination is within the skill of one of ordinary skill in the art. It is preferable to have a substantially unobstructed printing surface visible in the cavity, so that only a very small portion of the piece is retained in notch 70. Marking units 130 and 140 may apply ink in printing steps. In some embodiments, ink applied by a printer at a first marking unit 140 is removed in an etching step at a second marking unit 130. In other embodiments, a composite image is formed on the piece by printing a first image at first marking unit 140, transporting the piece in a fixed orientation on the conveyor belt, and printing a second image in registration with the first image at a second marking unit (not shown) disposed to print on the same side of the piece as first marking unit 140 before the piece is carried around drum 110. Suitable printing techniques include contact methods, such as rotogravure, and non-contact methods such as ink-jet and laser printing. Ink-jet printing includes continuous-jet printing and drop-on-demand printing, capable of printing a high resolution image having a resolution greater than about 100 dots per inch (39 dots per cm), preferably greater than about 250 dots per inch (98 dots per cm), and even more preferably greater than about 400 dots per inch (157 dots per cm).

In embodiments of the invention, an inspection unit can be positioned after a marking unit in the travel path of the conveying belt. An inspection unit may use a laser sensor (reflectance or through-beam), a capacitance-type device, or other instrument to determine that an image has been correctly applied to the piece, that the piece is damaged, or otherwise needs to be removed from the conveyor. An appropriate signal is sent to a removing unit 270, where defective pieces can be removed from a cavity using an air jet, or mechanical member. The inspection apparatus can be positioned after a marking unit anywhere along the belt transport path before the pieces are removed at unloading portion 40.

Example 1

An example of operation of a dual-sided printing apparatus according to a preferred embodiment of the invention may be described in connection with FIG. 6, wherein the conveying belt 10 is a continuous loop, including an inclined portion, a top portion of the transport path, and a bottom return portion of the transport path. A first print station 140 includes two print heads, 142, 144, one for each of the two lanes of cavities formed in the belt. These print heads print a first image through a first opening in the cavity on a first side of an edible piece while the edible piece is on the top portion of the transport path, and a pair of print heads 152, 154 prints respective second images through a second opening in the cavity, opposite said first opening, on a second side of the edible piece, opposite said first side, while the edible piece is on the bottom return portion of the transport path. The conveying belt is contacted by back-up belts 90 and 100 to hold the edible piece in the cavity during transport, while retaining members 180 and 280 (seen in the schematic side view of FIG. 1) contact the second side of the belt and retain the pieces in the cavities in the places on the transport path where a back-up belt is not provided.

Figure 6:
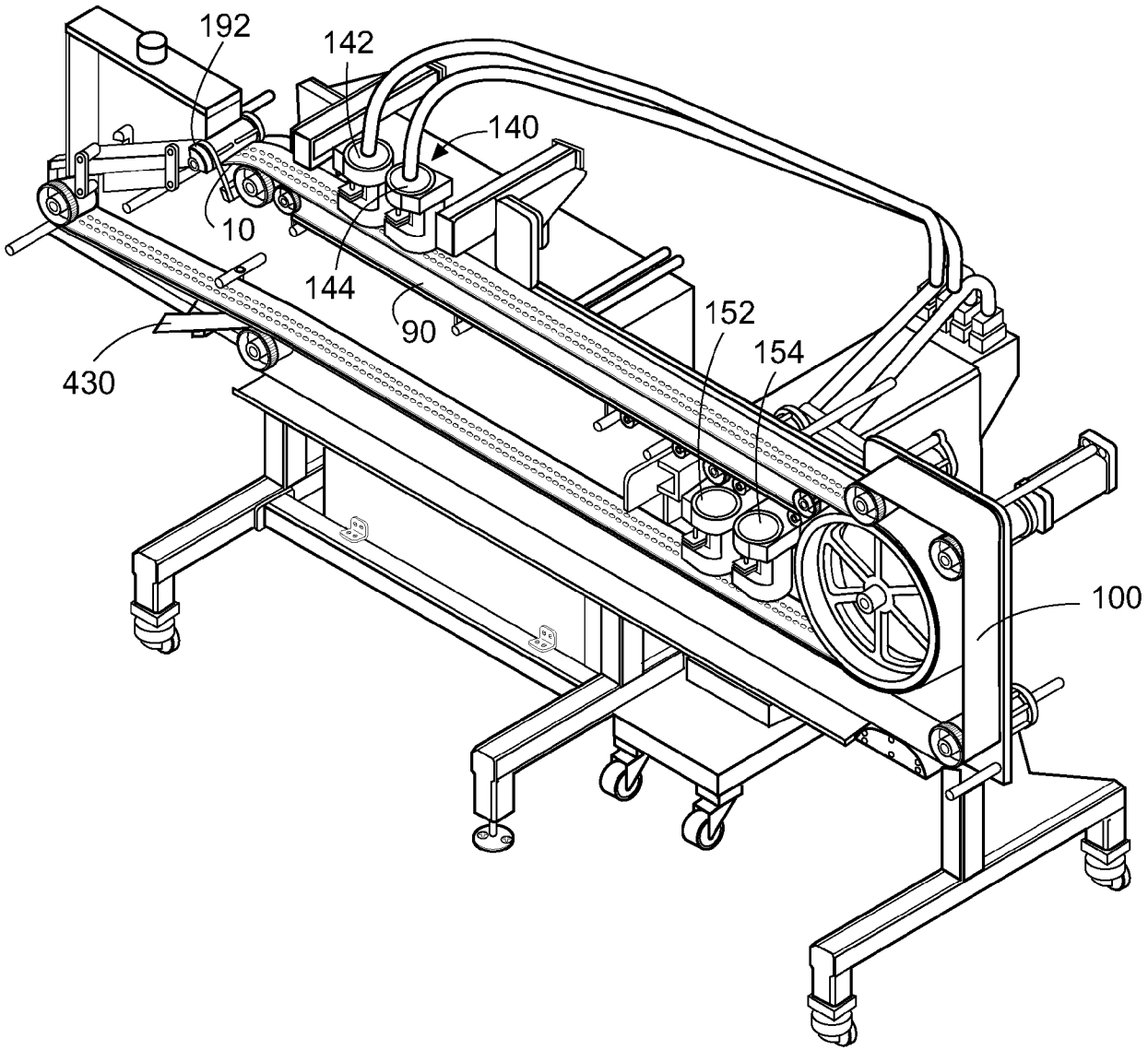
FIG. 6 is a perspective view of an apparatus according to an embodiment of the invention.

The pilot plant production-scale unit substantially according to FIG. 6 was made with a commercially available continuous urethane/Kevlar® timing belt, constructed from urethane extrusion and Kevlar® cord reinforcement and provided with a Teflon® coating to reduce friction. The timing teeth on lateral sides of the belt were spaced at a pitch of 0.5 inch (13 mm) in the direction of travel of the belt. Two lanes of cavities were machined into the belt at a pitch of 1.00 inch (25 mm). At this spacing, with two lanes running the entire circuit of the belt, a total of 552 cavities is provided.

Edible pieces (not shown) were provided in hopper 190 on an inclined portion of the belt path. In the embodiment shown, the pieces were sugar-shelled confectionery pieces having curved surfaces. Each piece was about 0.5 inches (13 mm) in diameter and 0.25 inches (6.4 mm) thick, with a mass of about 0.875 grams.

In the embodiment shown, the belt was capable of running at a speed of about 300 feet per minute (91 m/min). Given the number of cavities and the size of the pieces described, that would yield a theoretical throughput of 7200 pieces per minute. However, consistent operation and printing were obtained at about 200 feet per minute (61 m/min). This yielded a theoretical throughput of 4800 pieces per minute, or at 90% fill efficiency, about 4320 pieces per minute. With a piece weight of 0.875 grams, the throughput may be estimated in the neighborhood of about 500 lbs/hr (227 kg/hr).

The hopper 190 was on a linear incline of 30 degrees from the horizontal, with product exposed to the belt for approximately 27 inches (69 cm). The amount of product weight upon the belt was held at approximately 40 to 80 lb (18 to 36 kg). As long as sufficient product weight in the hopper covered the belt, the apparatus maintained good fill efficiency. The pieces did not move significantly on the belt, such as by sliding on the belt, or standing on ends, before being directed to the cavities. Product that moved on the top of the belt to the hopper exit was diverted by counter-rotating brush 192 to direct product back into the hopper 190.

In the most preferred embodiments, phase change inks are provided to canisters dedicated to respective lanes of cavities on the conveying belt. A removal assembly is provided with a chute 430 to receive the printed pieces. The removal of pieces may be assisted by blowing air or other mechanical means.

Example 2

A small-scale retail unit was constructed substantially in accordance with FIG. 7 and using similar lentil-shaped confectionery pieces as in Example 1. The belt was a urethane/Kevlar® timing belt with a Teflon® coating. The unit was provided with one lane for pieces, with each cavity spaced at a 1.00 inch (25 mm) pitch, for a total of 100 cavities. The unit may be operated at a speed of 40 to 80 feet per minute (12 to 24 m/min), which leads to production rates of about 470 to 922 pieces per minute, or 0.91 to 1.78 lb per minute (0.41 to 0.81 kg/min), given a fill efficiency of about 96 percent to about 98 percent, although this is not a firm upper limit on the capability of the apparatus. As shown in FIG. 7, the conveying belt for the small-scale unit has an arc shaped inclined portion, from the 6 o'clock position through 70 degrees, with pieces exposed to 15 inches (38 cm) of belt having one lane of cavities at the hopper. The operation of the hopper promotes a tumbling action at the top with excess pieces falling backwards, with good recirculation motion, so that pieces at the base of the hopper fill nicely into the cavities.

Once pieces are loaded into the cavities, an inspection station 596 may be used to determine if a cavity is filled. As in the production-scale environment, inspection information may be used to control the action of print heads 540, 530 or to indicate that the loading operation needs to be modified. In the embodiment shown, retaining plates 580, 582, 586 and 588 contacting the second side of the belt are provided to retain the pieces in the cavities. Printing is conducted when the belt is on a vertical linear portion of the transport path, with space being provided between the retaining plates 586, 588, and between plates 584, 590 contacting the first side of the belt, so that the print heads 540 and 530 can access the pieces in the cavities. Pieces having images printed on two sides are removed at chute 430 and packaged.

The foregoing description of the preferred embodiments of the invention is for illustration only and is not to be deemed limiting of the invention, which is defined by the appended claims.

What is claimed is:

1. A conveying and marking apparatus comprising:

a continuous flexible conveying belt having a first side and a second side and extending along a transport path;

at least one cavity extending through the conveying belt adapted to receive an individual piece and having a first opening on the first side and a second opening on the second side, the first and second openings being on opposite sides of the belt and providing access to opposite surface areas of the individual piece, the first and second openings being dimensioned to permit marking on the individual piece through the openings on the first and second sides;

a conveyor adapted to move the conveying belt along the transport path, wherein the transport path includes an inclined portion and a linear portion;

at least one retaining member positioned against one of the first and second openings of the cavity and being located adjacent to and in contact with the conveying belt along a portion of the transport path to hold the individual piece in the cavity as the belt is conveyed along the portion of the transport path;

a dispenser adapted to dispense an individual piece into the cavity; and a marking unit positioned proximate the linear portion, wherein the marking unit is adapted to mark the piece positioned in the cavity.

2. The apparatus of claim 1, wherein the retaining member comprises a back-up belt contacting the conveying belt along a portion of the transport path.

3. The apparatus of claim 1, wherein the retaining member comprises a retaining plate contacting the conveying belt along a portion of the transport path.

4. The apparatus of claim 1, comprising a scalloped portion at a leading edge of the cavity, including a sloped surface extending at an angle from the leading edge of the cavity to a leading sidewall of the cavity.

5. The apparatus of claim 1, comprising a notch formed in a trailing sidewall of the cavity.

6. The apparatus of claim 1, comprising a first marking unit positioned at a first linear portion and adapted to mark a first surface area of the piece through the first opening on the first side of the conveying belt, and a second marking unit positioned at a second linear portion and adapted to mark a second surface area of the piece through the second opening on the second side of the conveying belt.

7. The apparatus of claim 1, wherein the marking unit is an ink-jet printer.

8. The apparatus of claim 1, wherein the dispenser is positioned at an inclined portion on the transport path, and the marking unit is positioned above a horizontal portion on the transport path.

9. The apparatus of claim 1, wherein the conveying belt comprises a plurality of cavities arranged in lanes.

10. The apparatus of claim 1, wherein the first and second openings are sized such that the piece can pass through the cavity.

11. A method for conveying and marking pieces, comprising the steps of:

conveying a continuous flexible conveying belt having a first side and a second side along a transport path including an inclined portion and a linear portion;

providing at least one cavity extending through the conveying belt and adapted to receive an individual piece, the at least one cavity having a first opening on the first side and a second opening on the second side, the first and second openings being on opposite sides of the belt and providing access to opposite surface areas of the individual piece, the first and second openings being dimensioned to permit marking on the individual piece through the openings on the first and second sides;

dispensing an individual piece into the cavity on the inclined portion of the transport path;

providing a retaining member positioned against one of the first and second openings of the cavity, the retaining member being located adjacent to and in contact with the conveying belt along a portion of the transport path;

retaining the piece in the cavity with a retaining as the belt is conveyed along the portion of the transport path;

positioning a marking unit proximate the linear portion; and marking the piece when the piece is proximate the marking unit on the transport path.

12. The method according to claim 11, further comprising contacting the conveying belt with a back-up belt along a portion of the transport path to hold the piece in the cavity.

13. The method according to claim 12, wherein the back-up belt moves at the same speed as the conveying belt at the linear portion.

14. The method according to claim 11, wherein a scalloped portion provided at a leading edge of the cavity in the direction of movement of the belt leads the piece into the cavity when the piece is dispensed onto the belt.

15. The method according to claim 11, comprising the step of securing the piece in a notch on the trailing sidewall of the cavity.

16. The method according to claim 11, comprising marking a first surface area of the piece through the first opening on a first side of the conveying belt in a first marking step; and marking a second surface area of the piece through the second opening on a second side of the conveying belt in a second marking step.

17. The method according to claim 16, wherein the first and second marking steps each comprise printing an ink jet image.

18. The method according to claim 11, comprising moving the conveying belt at a speed in a range of about 100 feet per minute (31 m/min) to about 300 feet per minute (91 m/min).

19. The method according to claim 11, comprising conveying a plurality of pieces in a plurality of cavities arranged in one or more lanes provided on the conveying belt.

20. The method according to claim 11, wherein the piece is an edible piece.

* * * * *

UNITED STATES PATENT AND TRADEMARK OFFICE

CERTIFICATE OF CORRECTION

PATENT NO. : 8,371,216 B2
APPLICATION NO. : 12/629977
DATED : February 12, 2013
INVENTOR(S) : Keith A. Chilsholm et al.

It is certified that error appears in the above-identified patent and that said Letters Patent is hereby corrected as shown below:

ON TITLE PAGE AT (56) U.S. PATENT DOCUMENTS:

"2003/0177919 A1 9/2003 Volder" should read --2003/0177919 A1 9/2003 De Volder--.

ON TITLE PAGE AT (56) FOREIGN PATENT DOCUMENTS:

"WO 91-01884 2/1999" should read --WO 91-01884 2/1991--.

IN THE CLAIMS:

COLUMN 12:

Line 62, "retaining" (second occurrence) should read --retaining member--.

Signed and Sealed this
Seventh Day of May, 2013

Teresa Stanek Rea
*Acting Director of the United States Patent and Trademark Office*